United States Patent [19]

Manfredi

[11] 3,971,696

[45] July 27, 1976

[54] PAPER WEB DECURLING APPARATUS

[75] Inventor: John L. Manfredi, West Chester, Pa.

[73] Assignee: The Moore & White Company, Philadelphia, Pa.

[22] Filed: Oct. 1, 1975

[21] Appl. No.: 618,495

[52] U.S. Cl. ..... 162/271; 93/1 R; 226/199

[51] Int. Cl.[2] ..... D21F 7/00

[58] Field of Search ..... 93/1 R; 162/197, 270, 162/271; 156/200, 229; 226/197, 198, 199, 196

[56] References Cited

UNITED STATES PATENTS

| | | | |
|---|---|---|---|
| 2,918,897 | 12/1959 | Zernov | 162/271 X |
| 3,546,067 | 12/1970 | Heidepriem | 162/271 |
| 3,649,447 | 3/1972 | Turner | 162/271 |
| 3,661,703 | 5/1972 | Shelor | 162/271 |

FOREIGN PATENTS OR APPLICATIONS

| | | | |
|---|---|---|---|
| 377,649 | 5/1964 | Switzerland | 162/197 |

*Primary Examiner*—James F. Coan
*Attorney, Agent, or Firm*—Howson and Howson

[57] ABSTRACT

Paper web decurling apparatus comprising a freely rotatable relatively large diameter support roll and a freely rotatable small diameter decurling roller disposed parallel to the support roll for pressure engagement with a paper web thereon. Selectively operable means are provided for adjustably varying the pressure of the decurling roller against the paper web and support roll and selectively operable means are provided to rotationally position the decurling roller to engage the paper web on the support roll at any desired location circumferentially of said support roll.

10 Claims, 7 Drawing Figures

PAPER WEB DECURLING APPARATUS

Figures 1, 3:
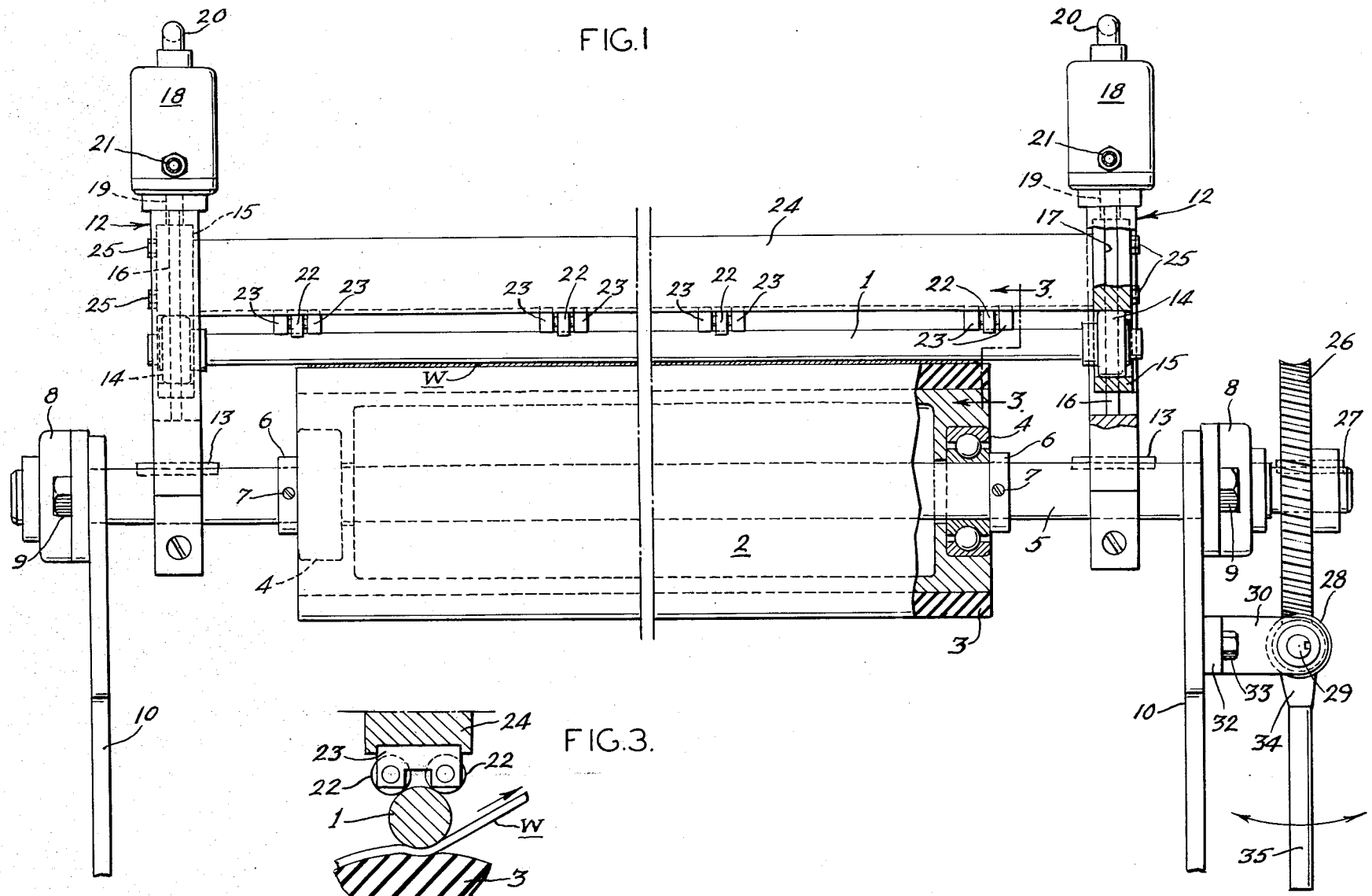

This invention relates to new and useful improvements in decurling apparatus for removing the curvature or curl from a web of paper or paperboard withdrawn from a roll.

In the manufacture of paper and paperboard the web of paper is usually wound on a small diameter mandrel into a roll of relatively large diameter until the paper is ready to be drawn from the roll and cut into sheets or converted into other products. The paper webs are wound on the mandrel under tension and while in the roll the paper acquires a permanent curvature or curl that is generally related to the radius of curvature of the paper web in the particular roll. Accordingly, while in the outer peripheral portions of a relatively large diameter roll the paper may have very little or no curl, the degree of curvature or curl in the paper web increases and becomes more pronounced as the diameter of the roll diminishes when the paper web is unwound therefrom down to the relatively small diameter of the mandrel on which the roll is wound.

Numerous attempts have been made heretofore to provide apparatus for effectively removing the curvature or curl from paper webs that have been wound on rolls. Some of these attempts have been more effective than others, but all of them have been characterized by one or more objectionable factors and requirements that precluded their complete success. For example, in most prior decurling apparatus it is necessary to maintain the paper web under constant tension at all times in order to effect a good decurl, and it is difficult to maintain the web tension constant as the diameter of the roll of paper diminishes. Also, in many instances prior decurling apparatus has not been capable of infinite selective adjustment according to the degree of curvature or curl in the paper web so that it is frequently not possible to remove the curvature or curl from the entire length of the paper web on the roll. Furthermore, prior decurling apparatus in many instances was constructed and operable primarily to decurl paper webs unwound from the top of the roll having a tendency to curl downwardly and were not readily adaptable to decurling paper webs unwound from the bottom of a roll having a tendency to curl upwardly.

With the foregoing in mind, an object of the present invention is to provide a novel apparatus for decurling paper webs that is not dependant upon maintaining the paper web under constant tension and is operable effectively to decurl the paper web regardless of the degree of tension in the paper web or any variations of tension therein.

Another object of the invention is to provide paper decurling apparatus as set forth that is infinitely adjustable selectively according to the degree of curvature or curl in the paper web as it is unwound from the roll and is operable effectively to remove the curvature or curl from the entire length of the paper web on the roll.

Another object of the invention is to provide paper decurling apparatus as aforesaid that is constructed and operable effectively to decurl a paper web regardless of the direction in which the curvature or curl therein has a tendency to curl.

A further object of the invention is to provide decurling apparatus for paper webs having the features set forth that is of comparatively simplified construction, inexpensive to manufacture, and highly efficient and foolproof in operation.

Figures 2, 4, 5:
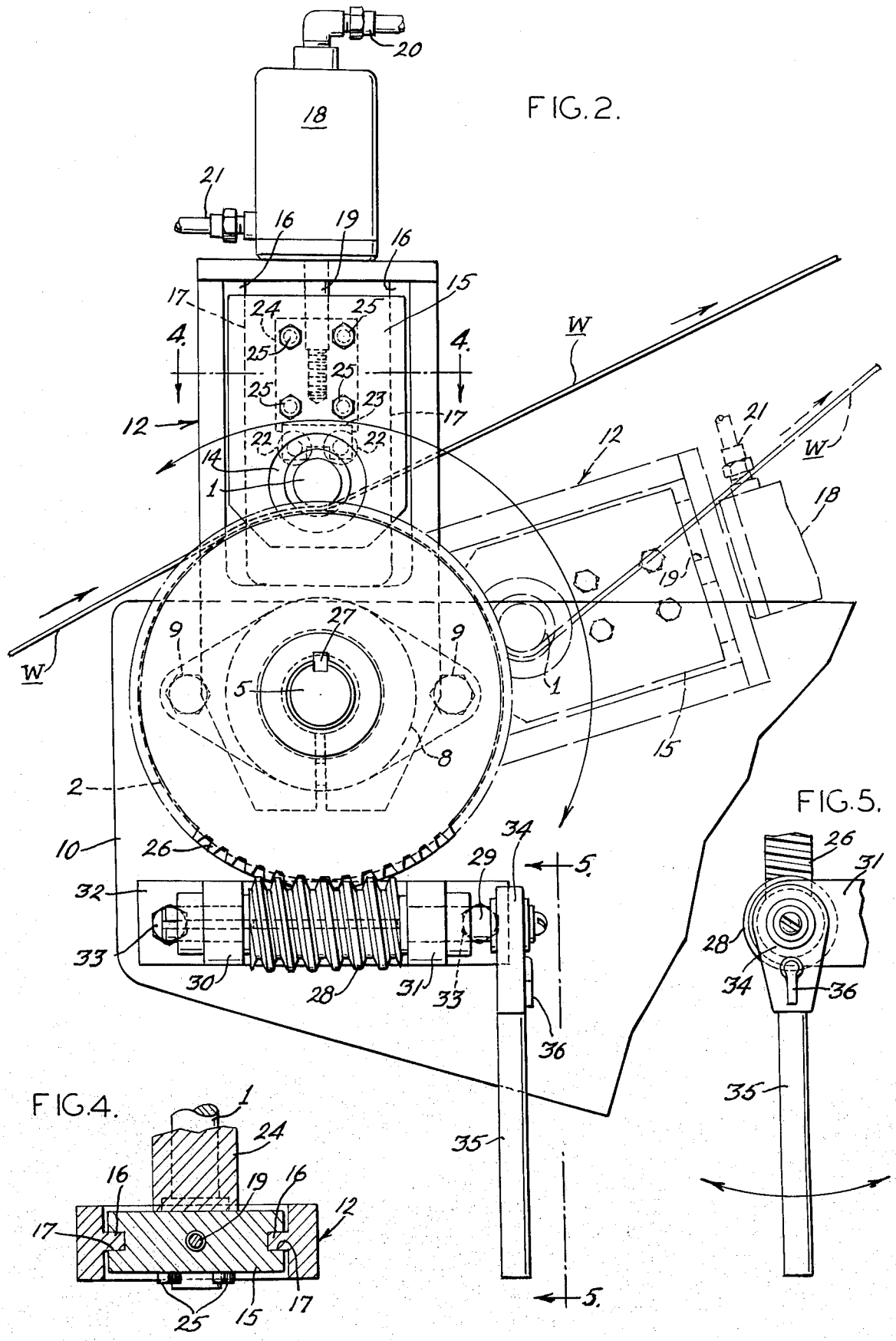
Figure 6:
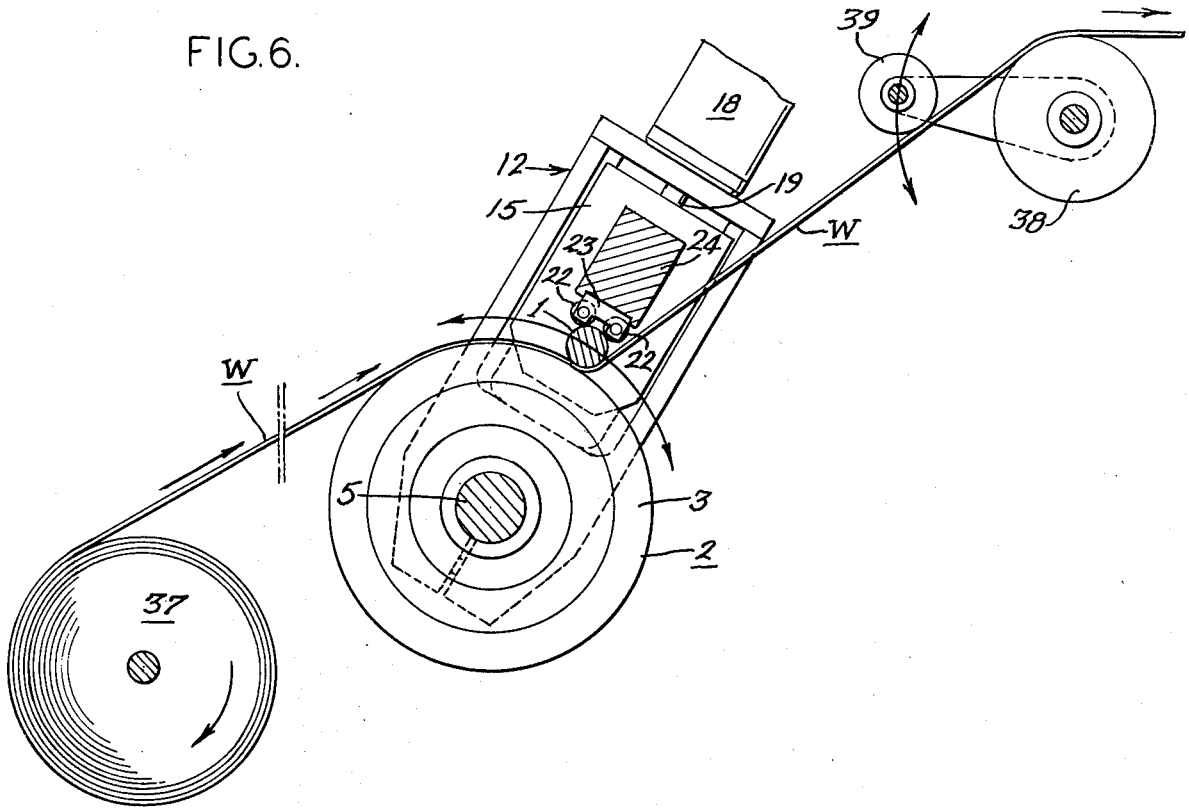
Figure 7:
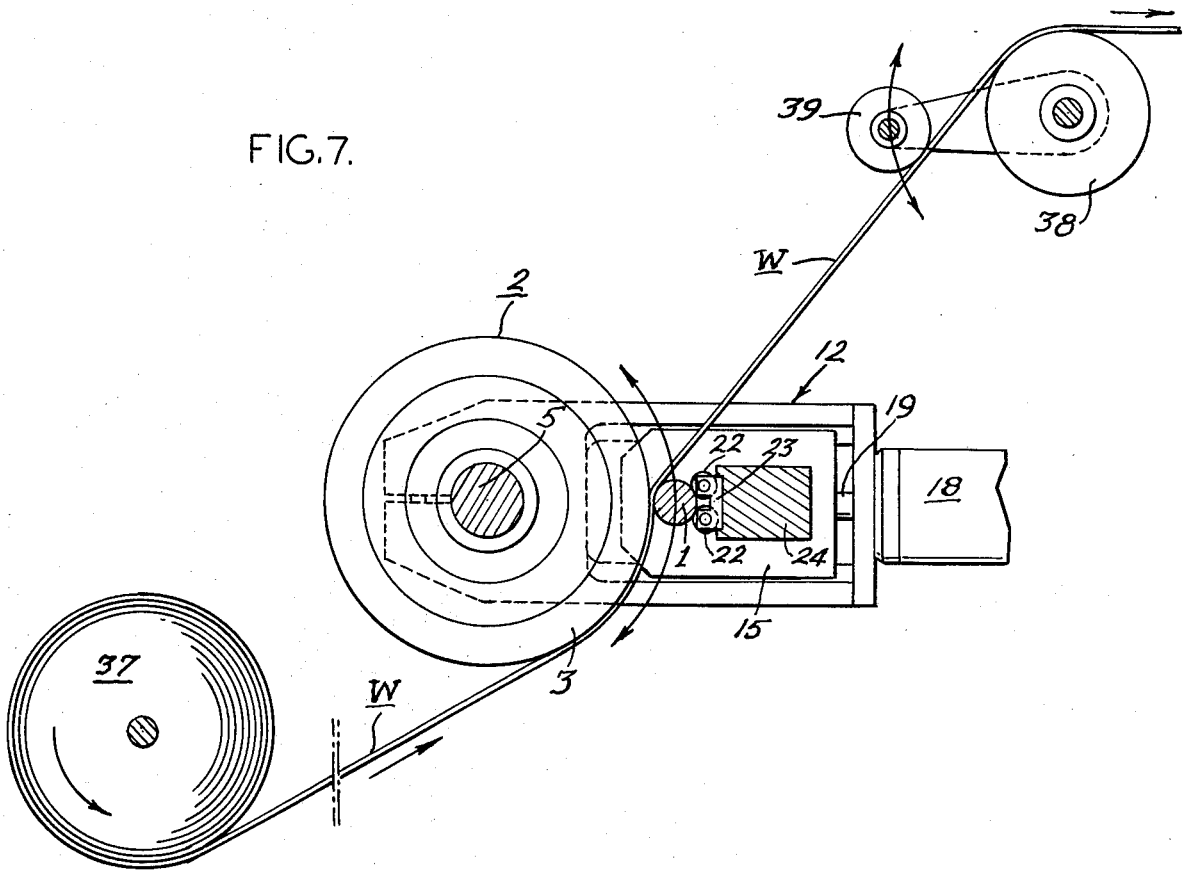

These and other objects of the invention and the features and details of the construction and operation thereof are hereinafter set forth and described with reference to the accompanying drawings, in which:

FIG. 1 is a front elevation view partially in section of one embodiment of paper web decurling apparatus made according to the present invention, FIG. 2 is an enlarged end elevational view of the apparatus disclosed in FIG. 1 as viewed from the right hand end thereof, FIG. 3 is an enlarged fragmentary sectional view on line 3—3, FIG. 1, FIG. 4 is a fragmentary sectional view on line 4—4, FIG. 2, FIG. 5 is a fragmentary elevational view on line 5—5, FIG. 2, FIG. 6 is a schematic end elevational view similar to FIG. 2 showing one operative arrangement of the decurling apparatus, and FIG. 7 is a schematic view similar to FIG. 6 showing another operative arrangement of the apparatus.

Referring now to the drawings, and more particularly to FIGS. 1 and 2 thereof, paper web decurling apparatus made according to the present invention comprises essentially a comparatively small diameter rotatable decurling roller 1 and a relatively larger diameter rotatable support roll 2 having a resilient outer cover 3 of natural or synthetic rubber or the equivalent. The roller 1 and roll 2 have parallel axes and are disposed in cooperative engagement with the opposite surfaces of a web of paper or paperboard W passing therebetween.

In the embodiment of the invention illustrated, the support roll 2 is rotatably mounted by means of bearings 4 upon a horizontal shaft 5 so that the roll 2 is freely rotatable on said shaft 5. The roll 2 is secured in position longitudinally on the shaft 5 by means of suitable collars 6 secured by set screws 7. The shaft 5 is also rotatably mounted by supporting the opposite end portions thereof in suitable bearings 8 that are secured by bolts 9 to an upstanding stationary frame structure 10 of the decurling apparatus. By this construction the shaft 5 is rotatable about its axis to any desired position relative to the support roll 2 mounted thereon and the stationary support frame structure 10.

Mounted on the shaft 5 for rotation therewith is a pair of radially extending housings 12 in which the decurling roller 1 is rotatably supported. The housings are mounted in spaced apart parallel relation to each other on the shaft 5 adjacent opposite ends of the roll 2 and are fixedly secured on said shaft 5 by means of keys 13. By this construction the housings 12 and decurling roller 1 can be rotated to any desired position circumferentially with respect to the support roll 2 by rotating the shaft 5 as hereinafter described. The decurling roller 1 has its opposite ends journalled in suitable bearings 14 secured in support blocks 15 mounted in the housings 12. The blocks 15 are mounted in the housings 12 for radial movement relative to the roll 2 and shaft 5 by means of oppositely projecting parallel guide rails 16 in said housings 12 that slidably engage in grooves 17 formed in the opposite sides of the blocks 15.

The decurling roller 1 is biased inwardly and adapted to engage the paper web W against the resilient cover 3 of the support roll 2 at a selected pressure to deflect the paper web and resilient cover 3 to the extent necessary to decurl the paper. In the illustrated embodiment of the invention this is accomplished by means of rams 18 mounted on the radial extremities of the housings 12 and connected to the support blocks 15 by piston rods 19. The rams 18 are actuated by pressure fluid connected thereto by conduits 20 and 21 and selectively regulated by conventional control means (not shown) to urge the decurling roller 1 into engagement with the paper web W against the resilient surface of the support roll 2 at the pressure required to produce the desired deflection of the paper.

Since the decurling roller 1 is of small diameter and normally rotates at high speed, it is desirable to prevent deflection or whip of the roller 1 during decurling operation of the apparatus. In the embodiment of the invention shown, this is accomplished by providing a plurality of pairs of back-up rollers 22 that bear inwardly against the decurling roller 1 opposite the support roll 2. The pairs of rollers 22 are rotatably mounted in brackets 23 arranged in longitudinally spaced relation along the shaft 5 and secured at the inner side of a supporting beam 24. The beam 24 extends between the housings 12 parallel to the roller 1 and has its opposite ends secured by bolts 25 to the support blocks 15 in said housings 12. Thus the supporting beam 24, back-up rollers 22 and the decurling roller 1 move as a unit radially with respect to the paper web W and support roll 2.

Rotation of the shaft 5 to position the decurling roller 1 circumferentially of the roll 2 as desired may be accomplished manually or by suitable power means as preferred. In either event a worm wheel 26 is mounted on one end of the shaft 5 and fixedly secured thereon by a key 27. Meshed with the worm wheel 26, for example, at the underside thereof, is a worm gear 28 that is fixedly secured on a shaft 29 which has its opposite end portions rotatably mounted in the laterally spaced arms 30 and 31 of a bracket 32 secured by bolts 33 to the stationary supporting frame structure 10.

In the illustrated embodiment of the invention, actuation of the worm gear 28 to rotationally position the decurling roller 1 is accomplished by manually operated means. Thus, as shown in FIGS. 2 and 5 one end of the worm gear shaft 29 has mounted thereon a two way ratchet mechanism 34 of conventional type having an operating handle 35 and a direction change lever 36 whereby actuation of the handle 35 in the clockwise or counter-clockwise direction with respect to FIG. 5 operates through the ratchet mechanism 34, worm gear 28 and worm wheel 25 to rotate the shaft 5 in the corresponding direction. There is a substantial gear reduction ratio between the worm gear 28 and the worm wheel 26 so that actuation of the handle 35 in either direction through a selected angle of rotation operates to rotate the shaft 5 in the corresponding direction through a much smaller angle of rotation.

In lieu of the manually operated ratchet mechanism 34 it will be apparent that the worm gear 28 can be actuated by other manual means such as a crank handle or by suitable power means such as a reversible electric motor which can be controlled by the operator from a remote location.

A typical operation of decurling apparatus made in accordance with the present invention is schematically illustrated in FIG. 6 of the drawings wherein a web W of paperboard is drawn from a parent roll 37 by pull rolls (not shown) and passes about a portion of the circumference of the resilient surface 3 of the support roll 2 between the latter and the decurling roller 1 and a pair of rolls 38 and 39. At the start of the decurling operation, the operator, based on his experience and knowledge of the weight and density of the paperboard, actuates the shaft 5 to position the decurling roller 1 at a selected position circumferentially with respect to the support roll 2 and also regulates the pressure fluid to the rams 18 to cause the decurling roller 1 to engage the web W at a selected pressure.

For example, for decurling 14 point paperboard, the operator will initially position the decurling roller 1 circumferentially of the support roll 2 at an angle of about 5° with respect to the vertical as shown in FIG. 6 and will set the pressure of the decurling roller 1 against the web W and roll 2 at about 30 pounds psi. During the decurling operation, as the web W is drawn from the parent roll 37 about the support roll 2 and under the decurling roller 1, the operator observes the sheets or sections of paper cut from the web to determine the presence of any curl therein and adjusts the circumferential position and pressure of the decurling roller 1 as required to eliminate any curl in the sheets. As the web W is unwound from the parent roll 37 and the diameter of said roll diminishes, the degree of curl in the web W becomes more pronounced and the operator will make the required adjustments in the apparatus. This is particularly so with respect to the position of the decurling roller 1 relative to the support roll 2 which must be at increasing angles, to about 35° during the decurling operation as the diameter of the parent roll 37 diminishes and the curl in the web W becomes more pronounced.

Another operation of the decurling apparatus of the present invention is schematically illustrated in FIG. 7 of the drawings wherein the web W is drawn from the bottom of the parent roll 37 about a lower portion of the circumference of the support roll 2 between it and the decurling roller 1. In this operation the curl in the web W faces upwardly with respect to the support roll 2, and the decurling roller 1 must be positioned circumferentially of the support roll 2 at different angles from the vertical, for example, from an initial angle of about 175° to a finish angle of about 90° as shown.

While certain embodiments of the invention have been shown and described, it is not intended to limit the invention to such disclosures and it is contemplated that modifications, changes and substitutions may be made and incorporated therein within the scope of the following claims.

I claim:

1. Decurling apparatus for paper webs comprising, a stationary frame structure a horizontal shaft rotatably mounted in said stationary support, a comparatively large diameter support roll rotatably mounted on said rotatable shaft and having a resilient circumferential surface for supporting a paper web drawn from another roll, a pair of radially extending housings mounted in spaced parallel relation on the shaft adjacent opposite ends of said support roll thereon and fixedly secured on said shaft for rotation therewith, a relatively small diameter decurling roller rotatably supported in said housings parallel to the support roll and disposed to engage a paper web thereon, means for urging the decurling roller into pressure engagement with a paper web on the support roll selectively operable to adjustably vary the pressure of said decurling roller against the paper web and said support roll, and means selectively operable to rotate the shaft and and housings thereon about said shaft axis in either direction relative to the stationary frame structure and support roll and thereby position the decurling roller to engage a paper web on said support roll at any desired location circumferentially of the support roll.

2. Decurling apparatus as claimed in claim 1 comprising means engaging the decurling roller opposite the support roll operable to prevent deflection and whip of said support roll.

3. Apparatus as claimed in claim 2 wherein the means engaging the decurling roller comprises a plurality of backup rollers longitudinally spaced along said decurling roller and mounted on a rigid beam secured in fixed parallel relation to the decurling roller.

4. Decurling apparatus as claimed in claim 1 wherein the decurling roller has its opposite ends rotatably journalled in blocks radially slidable in the housings secured on the shaft and the selectively operable means for varying the pressure of said decurling roller against the paper web and support roll comprises fluid actuated rams on said housings having piston rods connected to said blocks.

5. Decurling apparatus as claimed in claim 2 wherein the decurling roller has its opposite ends rotatably journalled in blocks radially slidable in the housings secured on the shaft and the selectively operable means for varying the pressure of said decurling roller against the paper web and support roll comprises fluid actuated rams on said housings having piston rods connected to said blocks.

6. Apparatus as claimed in claim 5 wherein the means engaging the decurling roller comprises a plurality of backup rollers longitudinally spaced along said decurling roller and mounted on a rigid beam secured in fixed parallel relation to the decurling roller.

7. Apparatus as claimed in claim 1 wherein the selectively operable means to rotate the support roll shaft and housing thereon comprises a second shaft, reduction gearing interconnected between said second shaft and said support roll shaft, and means to rotate the second shaft in either direction about its axis and thereby rotate the support roll shaft to selectively position the housings and decurling roller circumferentially with respect to the support roll.

8. Apparatus as claimed in claim 2 wherein the selectively operable means to rotate the support roll shaft and housings thereon comprises a second shaft, reduction gearing interconnected between said second shaft and said support roll shaft, and means to rotate the second shaft in either direction about its axis and thereby rotate the support roll shaft to selectively position the housings and decurling roller circumferentially with respect to the support roll.

9. Apparatus as claimed in claim 6 wherein the selectively operable means to rotate the support roll shaft and housings thereon comprises a second shaft, reduction gearing interconnected between said second shaft and said support roll shaft, and means to rotate the second shaft in either direction about its axis and thereby rotate the support roll shaft to selectively position the housings and decurling roller circumferentially with respect to the support roll.

10. Apparatus as claimed in claim 5 wherein the selectively operable means to rotate the support roll shaft and housings thereon comprises a second shaft, reduction gearing interconnected between said second shaft and said support roll shaft, and means to rotate the second shaft in either direction about its axis and thereby rotate the support roll shaft to selectively position the housings and decurling roller circumferentially with respect to the support roll.

* * * * *